US008533977B2

(12) United States Patent
Hide et al.

(10) Patent No.: US 8,533,977 B2
(45) Date of Patent: Sep. 17, 2013

(54) SHOE

(75) Inventors: Kazushi Hide, Tokyo (JP); Tomonori Sekine, Tokyo (JP); Tomokazu Kai, Tokyo (JP)

(73) Assignee: Yonex Kabushiki Kaisha, Tokyo (JP)

( * ) Notice: Subject to any disclaimer, the term of this patent is extended or adjusted under 35 U.S.C. 154(b) by 451 days.

(21) Appl. No.: 12/223,849

(22) PCT Filed: Feb. 7, 2007

(86) PCT No.: PCT/JP2007/052127
§ 371 (c)(1),
(2), (4) Date: May 20, 2010

(87) PCT Pub. No.: WO2007/091599
PCT Pub. Date: Aug. 16, 2007

(65) Prior Publication Data

US 2010/0287792 A1 Nov. 18, 2010

(30) Foreign Application Priority Data

Feb. 10, 2006 (JP) ..... 2006-034106
Sep. 12, 2006 (JP) ..... 2006-246790

(51) Int. Cl.
*A43B 7/24* (2006.01)

(52) U.S. Cl.
USPC ..... 36/30 R; 36/25 R; 36/142

(58) Field of Classification Search
USPC ..... 36/25 R, 114, 88, 142, 143, 144, 36/30 R
See application file for complete search history.

(56) References Cited

U.S. PATENT DOCUMENTS 4,769,927 A * 9/1988 Liggett et al. ..... 36/88
5,279,051 A * 1/1994 Whatley ..... 36/25 R (Continued)

FOREIGN PATENT DOCUMENTS

| | | |
|---|---|---|
| DE | 4134248 A1 | 4/1992 |
| EP | 0424471 A1 | 5/1991 |
| GB | 2333688 A | 8/1999 |
| JP | 64-47205 | 3/1989 |

(Continued)

OTHER PUBLICATIONS

European Search Report, Feb. 22, 2011.

(Continued)

*Primary Examiner* — Marie Patterson
(74) *Attorney, Agent, or Firm* — Nutter McClennen & Fish LLP; John J. Penny, Jr.; Christina M. Sperry

(57) ABSTRACT

In order to provide an athletic shoe that does not get caught even when a strong effort to hold on is made when sliding sideways, and that allows for light footwork, the present invention provides an athletic shoe that has an undersurface of a midsole 22 that is formed with a raised portion 24, along a circumferential side edge thereof affixed with an outersole 30 that forms an outsole, and an extending portion 32 that extends up to a circumferential side surface of the midsole is formed at a perimeter edge of the outersole, wherein: at a portion along a little toe of the circumferential side surface 22*a* of the midsole, a bulged portion 29 having a thickness equal to or more than a thickness substantially corresponding to a thickness of the raised portion 24 of the midsole in a shoe width direction is integrally formed so as to protrude outward, and the extending portion 32 is formed extending from the perimeter edge of the outersole 30 toward a protruding surface of the bulged portion 29 and the extending portion 32 is formed in a large arcuate curve and is made to go round the protruding surface of the bulged portion.

1 Claim, 8 Drawing Sheets

(56) References Cited

U.S. PATENT DOCUMENTS

| | | | | |
|---|---|---|---|---|
| 5,379,530 | A * | 1/1995 | Bell et al. | 36/89 |
| 6,119,373 | A * | 9/2000 | Gebhard et al. | 36/114 |
| 6,308,439 | B1 * | 10/2001 | Ellis, III | 36/25 R |
| 6,438,873 | B1 * | 8/2002 | Gebhard et al. | 36/114 |
| 6,474,006 | B1 * | 11/2002 | Cummings et al. | 36/142 |
| 6,497,058 | B2 * | 12/2002 | Dietrich et al. | 36/69 |
| 6,609,312 | B1 | 8/2003 | Ellis, III | |
| 6,871,421 | B2 * | 3/2005 | Potter et al. | 36/29 |
| 2002/0050078 | A1 * | 5/2002 | Dietrich et al. | 36/88 |
| 2003/0131497 | A1 * | 7/2003 | Ellis, III | 36/25 R |
| 2004/0250447 | A1 * | 12/2004 | Ellis, III | 36/25 R |
| 2005/0278980 | A1 | 12/2005 | Berend et al. | |
| 2009/0260259 | A1 * | 10/2009 | Berend | 36/88 |

FOREIGN PATENT DOCUMENTS

| | | | |
|---|---|---|---|
| JP | 64-047205 | U | 3/1989 |
| JP | 2929615 | B2 | 8/1999 |
| JP | 2000-023705 | | 1/2000 |
| JP | 2000-023705 | A | 1/2000 |
| JP | 2005-065816 | | 3/2005 |
| WO | 99/38406 | A1 | 8/1999 |

OTHER PUBLICATIONS

Japanese Office Action Application No. 2006-246790, dated Dec. 6, 2011.

Chinese Office Action issued Aug. 20, 2010 and its English translation.

International Search Report dated Mar. 6, 2007.

* cited by examiner

SHOE

CROSS REFERENCE TO RELATED APPLICATIONS

The present application claims priority from Japanese Patent Application No. 2006-34106 filed on Feb. 10, 2006 and Japanese Patent Application No. 2006-246790 filed on Sep. 12, 2006 which are incorporated herein by reference.

TECHNICAL FIELD

The present invention relates to an athletic shoe whose sole structure is made so that light footwork can be obtained.

BACKGROUND ART

In general, an athletic shoe, of course requires to be lightweight but also requires to, such as, exert a firm grip of the ground surface when stepping forward or other directions, demonstrate shock absorption characteristics when landing, and show stability when sliding sideways, in other words, high rigidity against a lateral force and ability to retain the foot portion.

Hence, for the purpose of satisfying the requirements like those described above, the sole constructions of the prior art have been configured as shown in FIGS. 9-12. Note that FIG. 9(*a*) shows a side view of the inner side portion of the sole, FIG. 9(*b*) is a view of the bottom surface thereof, FIG. 9(*c*) shows a side view of the outer side portion thereof, FIG. 10 is a front view of the sole seen from the toe side, FIG. 11 is a sectional view taken along line XI-XI of each of the drawings in FIG. 9, and similarly FIG. 12 is a sectional view taken along line XII-XII.

Specifically, as shown in each of the drawings in FIGS. 9-12, the sole 2 is mainly composed of an outer sole 4 made of rubber or resin for securing grip force and a midsole 6 made of a resin foam body for securing shock absorption. As shown in each of the drawings in FIGS. 9-12, except FIG. 9(*b*), the midsole 6 has formed along its circumferential side edge a raised portion 8 that extends in the upward direction, and this raised portion 8 is made to be connected to an upper member (not shown) that corresponds to a main body of a shoe. Further, this raised portion 8 has a function of increasing the ability to retain the foot portion, as well.

As shown in FIG. 9, the outer sole 4 is formed of two members divided into front and back members with a shank-piece therebetween, and each of them are affixed to an undersurface of the midsole 6 to form an outsole on the undersurface of the sole, as shown in the sectional diagrams of FIGS. 10-12. Additionally, as shown in each of the drawings in FIGS. 9-12, except FIG. 9(*b*), the perimeter edge portion of the outer sole 4, along the bottom edge portion of the circumferential side face 6*a* of the midsole 6, has formed an extending portion 10, which extends upward toward the circumferential side face 6*a* of the midsole 6. Further, corners of the perimeter edge portion of the outer sole 6, provided with the extending portion 10, are chamfered to form a small arc shape with a radius of about a few millimeters. The radius of the arc-shaped chamfer is set to approximately 5 mm at the inner foot portion side and approximately 2 mm at the outer foot side. In addition, on the surface of the outer sole 4, grooves 12 for realizing a firm grip of the ground surface are extended up to the above described extending portion 10 to form a predetermined pattern that is spread over nearly the entire surface. Here, the reason for forming the chamfered shape of the above-described corner portion small to be approximately 2 mm at the outer foot portion side, is to enable a sufficient transmission of the force by the foot making effort to hold on to the ground surface side, and to prevent a twisting of the ankle in the outward direction, since the force by the foot making effort to hold on to control sliding acts locally on the outer foot portion side. In other words, conventionally, the common view was that if the chamfer radius of the outer foot portion side is increased, the effort made by the foot to hold on at sliding will lose effect so that the ankle is prone to twist in the outward direction.

Further, Japanese Patent No. 2929615 discloses as a technology of an athletic shoe that can improve the stability of footwork by controlling the drift of the sole in the lateral direction at landing, provision of a stabilizer at the outer side edge of the middle foot portion of the sole having a substantially L-shaped vertical section with a hardness factor of 50-70 (Japanese Industrial Standard-A hardness) whose lower side portion protrudes 1-3 mm outwards in a flared form, and in addition to the protrusion in the outward direction, another stabilizer below the undersurface of the sole that protrudes 1-3 mm, with the protruding ends of both of the stabilizers formed with rounded chamfers.

Patent document 1: Japanese Patent No. 2929615

DISCLOSURE OF INVENTION

However, with an athletic shoe with a conventional sole structure as shown in FIGS. 9-12 mentioned above, when stepping in the side direction with a strong effort to hold on to control the amount of sliding, there is a tendency for a sudden increase in the feeling that the corner of the circumferential edge of the outer sole gets caught and the braking force suddenly increases as well. And when such a feeling of the outer sole getting caught and a sudden increase in the braking force arises, the player's ankle is twisted or the like in the outward direction, making him/her likely to lose balance. For such reasons, the player being anxious about this will not be able to make a strong effort with his/her foot to hold on. This results in not being able to obtain appropriate sliding that is desired or the like, leading to a problem of light footwork being impaired.

Further, even with the sole proposed in Patent document 1, since the amount of protrusion toward the outside of the stabilizer at the lower side portion thereof is equal to or less than 3 mm, the radius of the chamfered shape formed at the tip of the protrusion is equal to or less than 3 mm at maximum, so that the catch of the protrusion is increased. In other words, it is considered that there is a tendency that the above described problem cannot be avoided. Additionally, the stabilizer made to protrude downward in addition to being made to protrude outward, increases the catching of the ground surface at the tip due to it being protruded in the downward direction, so again, it is considered that there is a tendency that the above described problem cannot be avoided.

The present invention was made in view of the above described problem, and its object is to provide an athletic shoe that does not get caught even when the foot makes a strong effort to hold on when sliding sideways, and allows for light footwork.

Another object of the invention is to provide an athletic shoe that can control, as much as possible, the upper member from swelling deformation in the outward direction when the foot makes a strong effort to hold on when sliding sideways.

In order to achieve the above described object, an athletic shoe according to an embodiment of the invention includes:

an undersurface of a midsole that is formed with a raised portion, for connecting with an upper member, along a circumferential side edge thereof affixed with an outersole that forms an outsole, and an extending portion that extends up to a circumferential side surface of the midsole formed at a perimeter edge of the outersole, characterized in that:

at a portion along a little toe of the circumferential side surface of the midsole, a bulged portion having a thickness equal to or more than a thickness substantially corresponding to a thickness of the raised portion of the midsole in a shoe width direction is integrally formed so as to protrude outward, and the extending portion is formed extending from the perimeter edge of the outersole toward a protruding surface of the bulged portion and the extending portion is formed in a large arcuate curve and is made to go round the protruding surface of the bulged portion.

According to an athletic shoe of the present invention, since the protruding surface of the bulged portion has an extending portion formed extending in a large arcuate curve from the perimeter edge of the outersole and provided to go therearound, even when the foot makes a strong effort to hold on when sliding laterally in the side direction or the like, the force by the foot making effort to hold on acts in a concentrated manner on the portion along the little toe where the protruding bulge is formed, so that it will be difficult for the outer sole to get caught and thus a braking force would not increase suddenly. Herewith, the player need not worry about the outer sole getting caught as mentioned above, so that he/she can make effort with his/her foot to hold on with an intended strength. As a result, light footwork that matches the player's own image will be allowed, such as, the player being able to control the amount of sliding easily. Furthermore, since the rigidity of the outer side portion of the midsole is increased by the bulged portion, bearing strength acting against lateral force at sliding is increased to control the deformation in the portion, so that a stable retaining of the foot portion is obtained.

Moreover, because a large arcuate curved portion is formed to the bulged portion formed to protrude in the outward direction, the ground contact width will not be reduced compared to the conventional ones. For such reason, when sliding sideways, sufficient amount of ground contact area is ensured so that such as twisting of the ankle can be certainly avoided.

Features and objects of the present invention other than ones stated above will be apparent from the following detailed description with reference to the drawings attached herein.

BEST MODE FOR CARRYING OUT THE INVENTION

At least the matters described hereunder are made obvious from the description of the specification and the appended drawings.

The preferred embodiments of the athletic shoe according to the present invention will be given in detail hereunder based on the appended drawings by exemplifying a tennis shoe.

First Embodiment

Figures 1A, 1B, 1C:
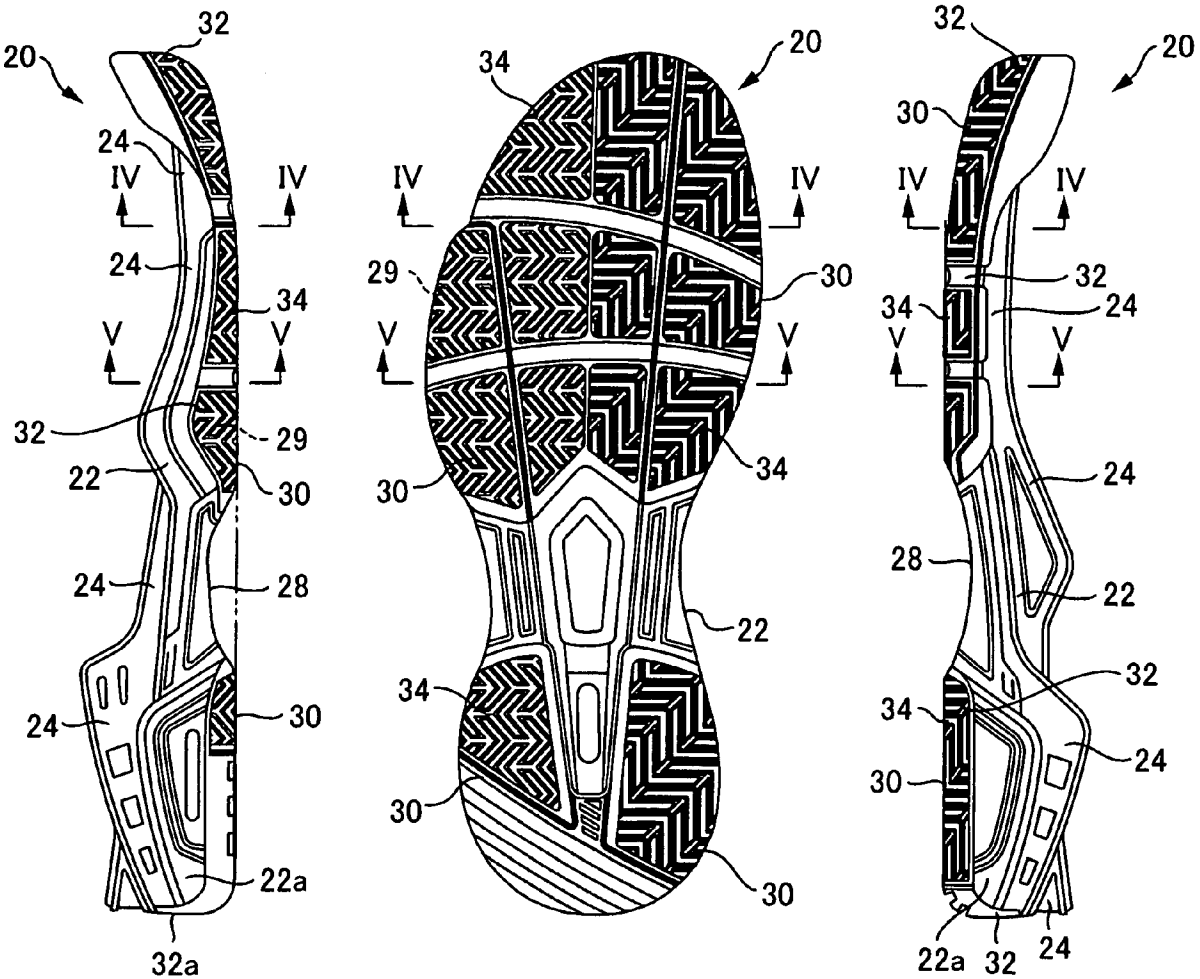
FIG. 1 is a view showing a sole of a first embodiment of an athletic shoe according to the present invention where FIG. 1(*a*) is a side view showing an inner side portion, FIG. 1(*b*) is a bottom view, and FIG. 1(*c*) is a side view showing an outer side portion.
Figure 2:
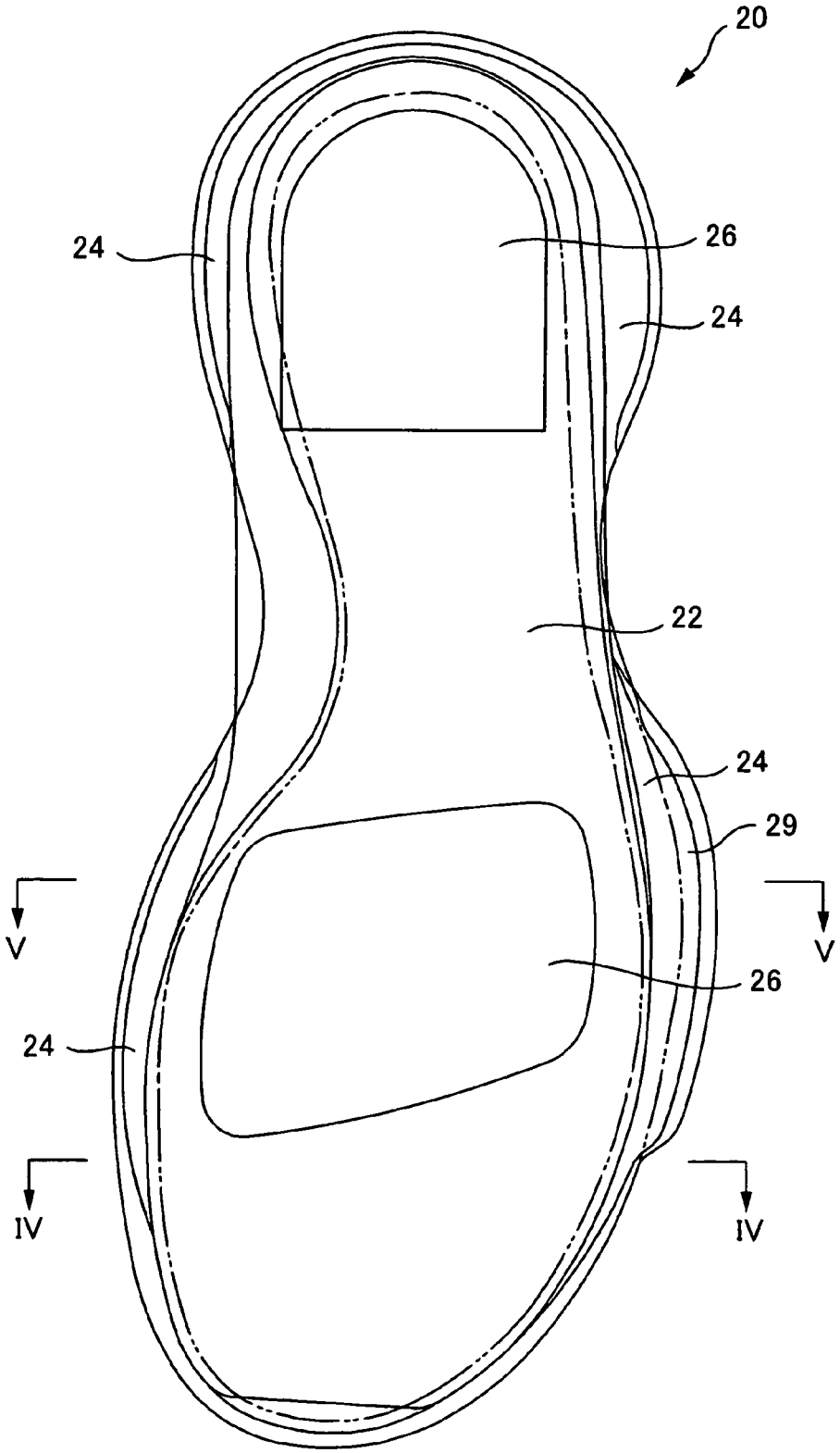
FIG. 2 is a plan view showing the sole of the first embodiment of an athletic shoe according to the present invention.
Figure 3:
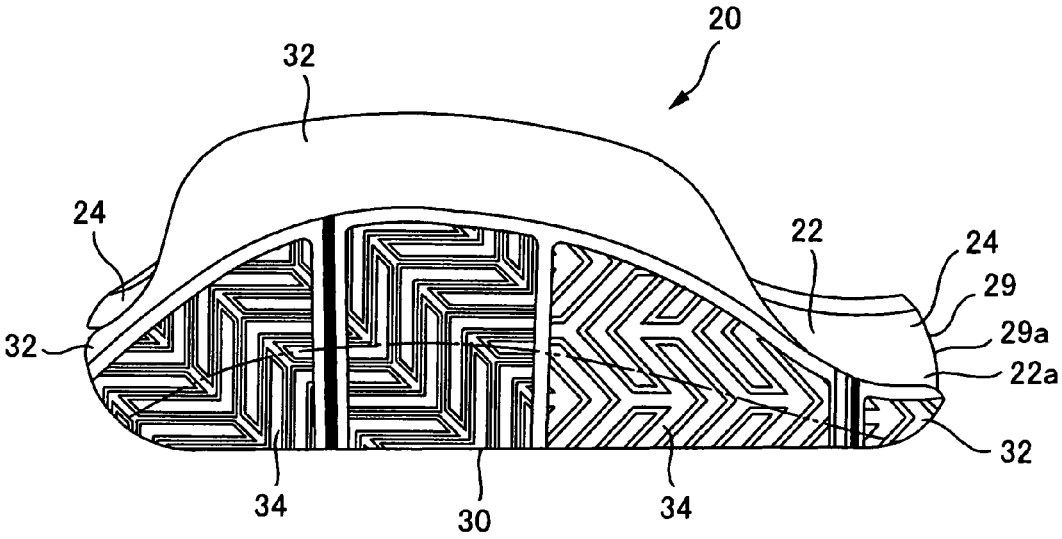
FIG. 3 is a front view of the sole seen from the toe side.
Figure 4:
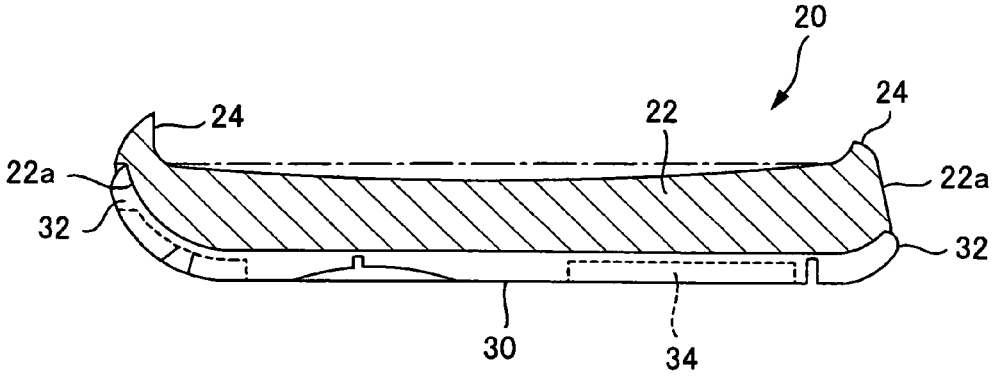
FIG. 4 is a sectional view taken along line IV-IV shown in each of the drawings in FIGS. 1 and 2.
Figure 5:
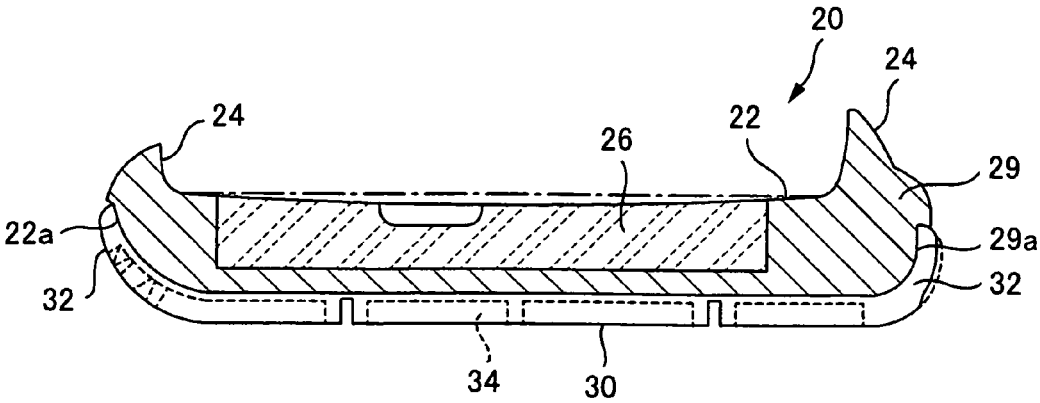
FIG. 5 is a sectional view taken along line V-V shown in each of the drawings in FIGS. 1 and 2.

FIGS. 1-5 show a first embodiment of an athletic shoe according to the present invention, where FIG. 1(*a*) is a side view showing the inner side portion of a sole, FIG. 1(*b*) is a bottom view, FIG. 1(*c*) is a side view showing the outer side portion, FIG. 2 is a plan view of the sole, FIG. 3 is a view of the sole seen from the toe side, FIG. 4 is a sectional view taken along line IV-IV shown in each of the drawings in FIG. 1, and similarly FIG. 5 is a sectional view taken along line V-V shown in each of the drawings in FIG. 1.

Here, the first embodiment of the tennis shoe shown in FIGS. 1-5 is for an advanced player, and is an improved model of a conventional one explained with the drawings shown in FIGS. 9-12. Therefore, as apparent from the drawings, their configuration has a number of parts that are in common and their basic configuration is substantially the same.

To be specific, as shown in each of the drawings in FIGS. 1-5, the sole 20 of this tennis shoe has a midsole 22 made of resin foam. As shown in FIGS. 1(*a*), 1(*c*) and FIGS. 2-5, this midsole 22 has along the entire surrounding of its circumferential side edge, a raised portion 24 formed upward to be connected with the upper member (not shown). Further, as shown in FIG. 2, on the upper surface of the midsole 22, recesses are formed at heel and forefoot portions. The recesses are provided with cushion material 26 made of resin foam that is softer than the midsole 22. Additionally, as shown in FIG. 1(*a*) and FIG. 1(*c*), an undersurface side of a shank portion 28 of the midsole 22 is upwardly bowed to form an arcuate curve.

As shown in each of the drawings in FIG. 1 and FIGS. 3-5, the midsole 22 has on its undersurface an outer sole 30 that forms an outsole when landing provided by bonding thereto. This outer sole 30 is not provided to the above described shank portion 28, but is formed of two parts of the heel portion and the forefoot portion with the shank portion 28 therebetween.

As shown in FIGS. 1(*a*), 1(*c*) and FIGS. 3-5, at the perimeter edge of this outer sole 30, there is formed an extending portion 32 that extends from the lower side to the upper side to reach the circumferential side face 22*a* of the midsole 22.

Note that the above configuration is common to that of the conventional embodiment shown in FIGS. 9-12.

By the way, as shown in FIGS. 1-5, of the circumferential side face 22*a* of the above described midsole 22, the portion at the outer foot-side along the little toe positioned ahead of the shank portion 28 has a bulged portion 29, having a thickness equal to or more than that substantially equal to the thickness in the shoe width direction of the raised portion 24 of the midsole 22, integrally formed to protrude outward. And, as shown in FIG. 5, this bulged portion 29 has, as described above, an extending portion 32 formed to extend from the peripheral edge of the outer sole 30 toward the protrusion surface 29*a* of the bulged portion 29. Here, the extending portion 32 is formed in a large arcuate curve along nearly its entire extending length and is made to go round the protruding surface 29*a* of the bulged portion 29. In the present embodiment, the specific radius of the extending portion 32 in an arcuate form is set to 10 mm, thus the arcuate surface is five times larger when compared with a conventional example where the radius of the chamfered shape was 2 mm.

Therefore, even when the foot makes an effort to hold on when sliding sideways there is hardly any chance of the outer sole getting caught and there is no sudden increase in the braking force by the outer sole getting caught. Hence, the posture of the player becomes stable when he/she is sliding, and a braking force that corresponds to the condition of the force exerted by the foot making effort to hold on can be easily obtained as well, so that the sliding can be easily controlled to an appropriate amount as desired. In other words, light footwork that matches the player's own image can be performed.

Additionally, grooves are formed on the outer side surface of the extending portion 32. Owing to this, even if the player inclines too much in the outward direction when he/she slides laterally, the grooves grip the ground tightly so that the player can avoid a twisting of his/her foot or slipping and falling.

Further, since the rigidity in the lateral direction of the outer foot portion of the midsole 22 is increased by the bulged portion 29, the bearing strength against the lateral force at sliding is increased and the deformation of the portion is restrained. For such reasons, the ability to retain the foot portion stably can be obtained and this will enable a further improvement in the stability of the player's posture.

Also, additional noteworthy points are that the raised portion 24, which is a typical conventional structure, has a bulged portion 29 formed to protrude laterally outward, and moreover, this bulged portion 29 has an extending portion 32 of the outer sole 30 provided to round the bulged portion 29 in a large arcuate curve. Thus, in comparison to the conventional ones, the width of the ground contact portion in the shoe width direction is not reduced. As a result, even when sliding in a lateral direction, enough contact area can be secured so that twisting of the ankle or the like can be certainly avoided.

Also, regarding the portion where the thenar is positioned, at the inner foot-side of themidsole 22, along this portion for over a predetermined longitudinal length thereof, the extending portion 32 of the outer sole 30 that extends toward the circumferential side face 22*a* of the midsole 22 is formed to have a large arcuate curve which is larger than that of the extending portion 32 formed to the above described bulged portion 29. And to be specific, the radius of the arc is set to 15 mm. This is addressed to making a strong step with the knee inclining inwardly when the player's weight is concentrated mainly in the vicinity of the thenar, in a case where making a strong step laterally. Actually, with the conventional ones, the portion at the inner foot-side of the midsole where the thenar is located was square-cornered and its ground contact area was small. However, according to the embodiment of the present invention, by making the extending portion 32 of the portion along the thenar have a large arcuate face, ground contact area of the outer sole 30 can be ensured even when an inward inclination of the knee is involved. As a result, with a sufficient amount of ground contact area of the outer sole 30 even when the inward inclination of the knee is involved, loss of a force by making a strong step can be avoided. In addition, by ensuring a sufficient amount of ground contact area, deformation of the sole can be made small so that the player can adjust his/her movement as intended. In this way, light footwork is realized.

As described above, according to this first embodiment, light footwork is possible without the outer sole getting caught even when a strong force by the foot making effort to hold on is applied when sliding sideways.

Note that the heel portion of the outer sole 30 can be formed with an arcuate curve. On account of this, a sufficient amount of ground contact area can be ensured even when making a step from the heel. Thus a nimble and reliable footwork can be realized even when making a step from the heel.

Second Embodiment

Figure 6:
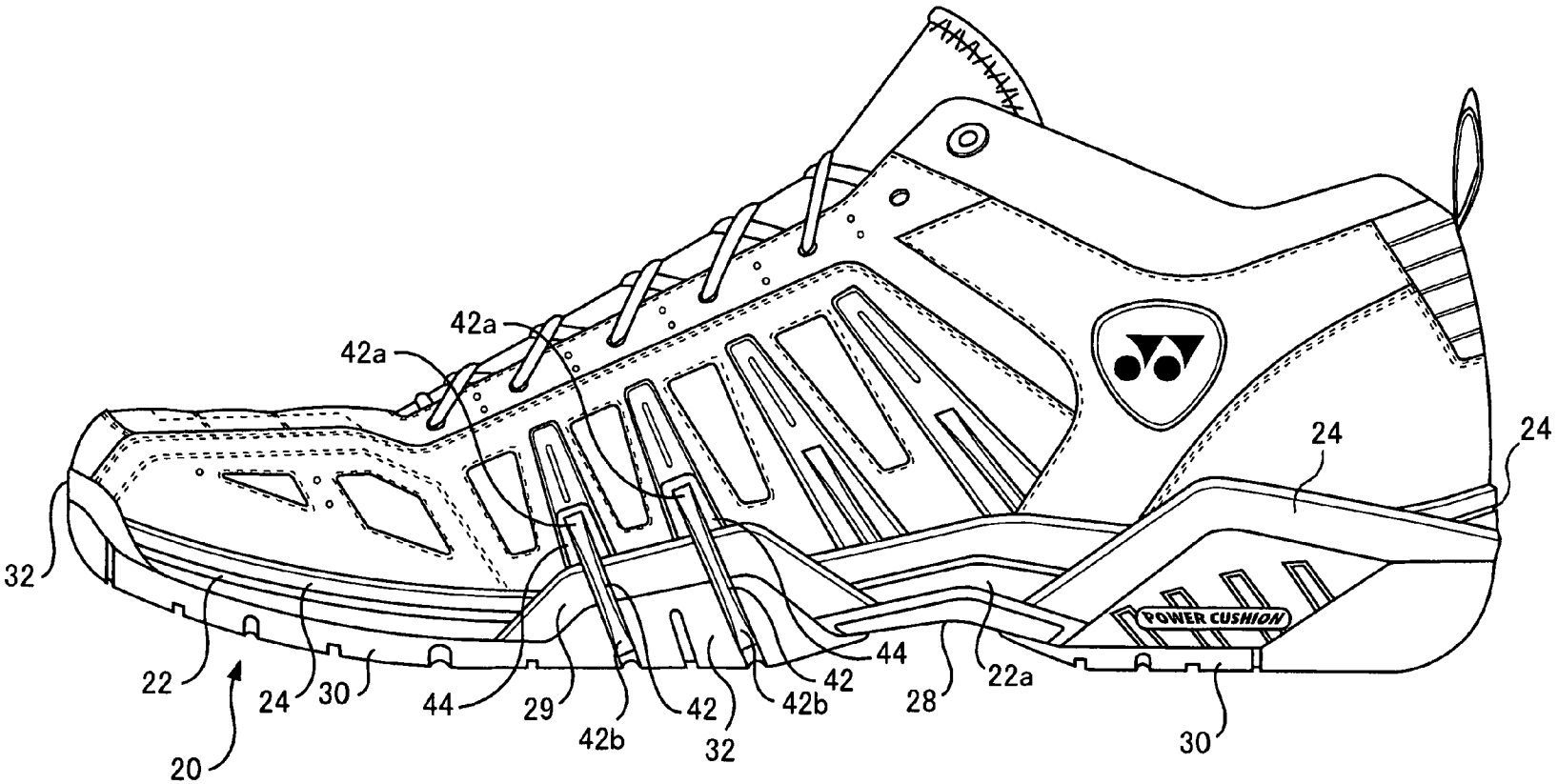
FIG. 6 is a side view showing the second embodiment of an athletic shoe according to the present invention.
Figure 7:
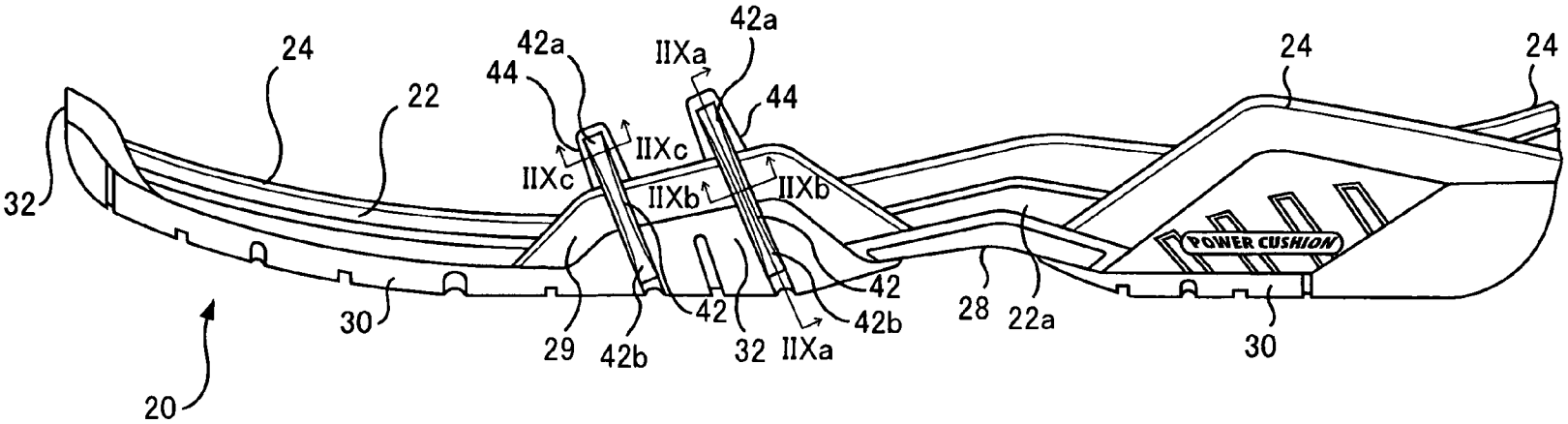
FIG. 7 is a side view showing the outer side portion of the sole of the athletic shoe shown in FIG. 6.
Figure 8A:
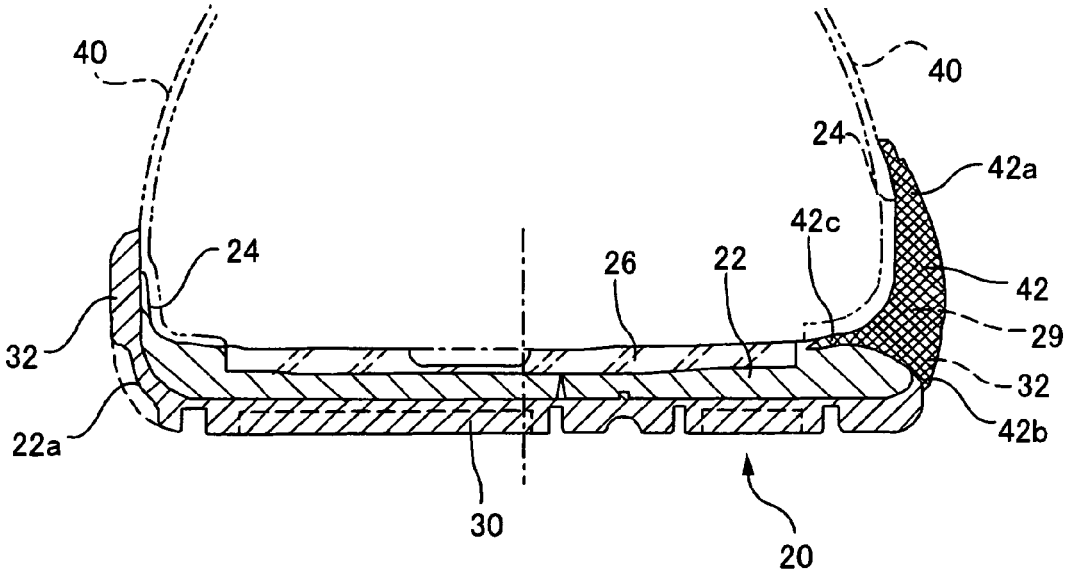
FIG. 8(*a*) is a sectional view taken along line IIXa-IIXa shown in FIG. 7, FIG. 8(*b*) is a sectional view taken along line IIXb-IIXb shown in FIG. 7, and FIG. 8(*c*) is a sectional view taken along line IIXc-IIXc shown in FIG. 7.
Figure 8B:
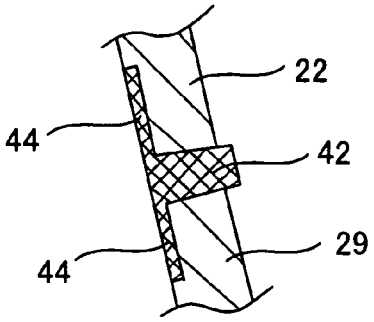
Figure 8C:
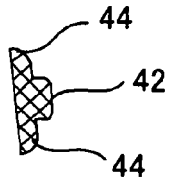
Figure 9C:
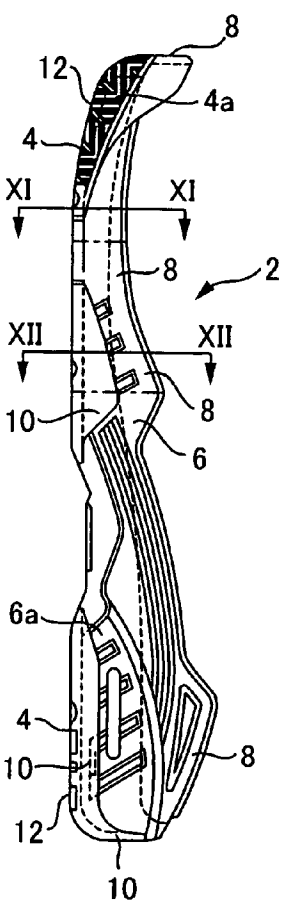
FIG. 9 shows a sole of a conventional athletic shoe where FIG. 9(*a*) is a side view showing the inner side portion, FIG. 9(*b*) is a bottom view, and FIG. 9(*c*) is a side view showing the outer side portion.
Figure 9B:
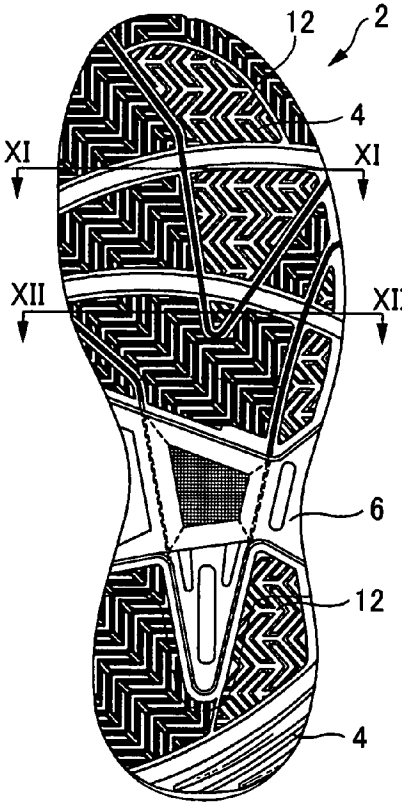
Figure 9A:
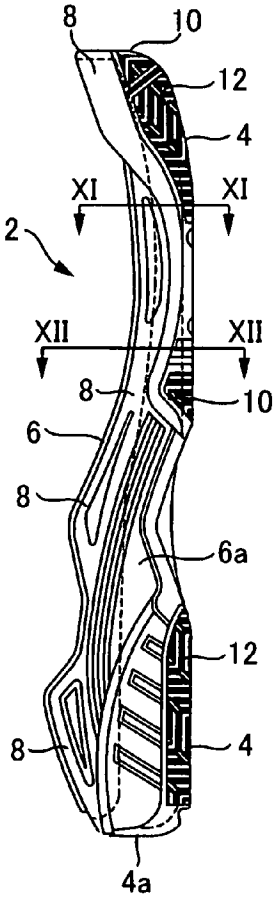
Figure 10:
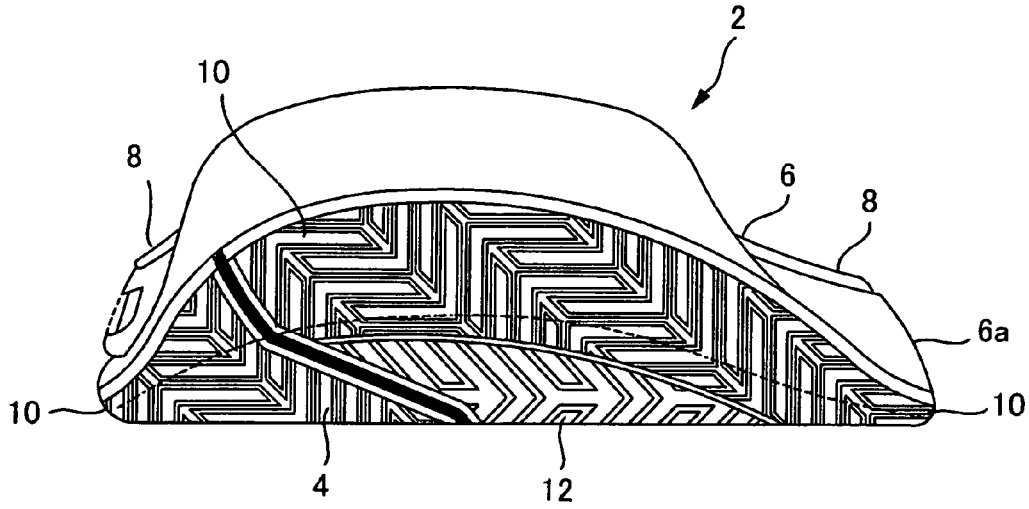
FIG. 10 is a front view of the sole of FIG. 9 seen from the toe side.
Figure 11:
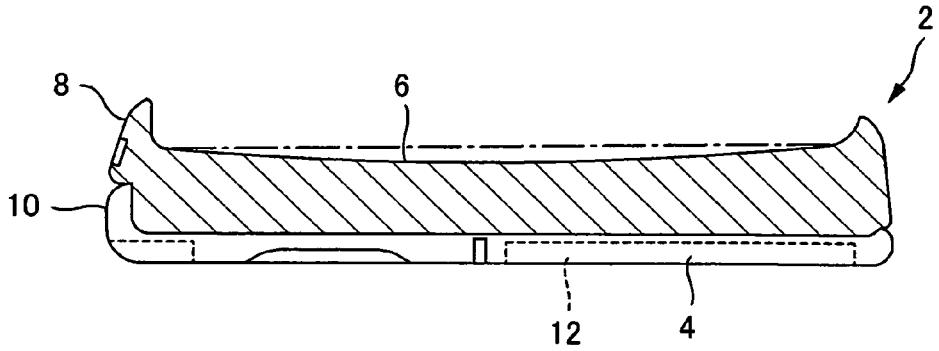
FIG. 11 is a sectional view taken along line XI-XI shown in each of the drawings in FIG. 9.
Figure 12:
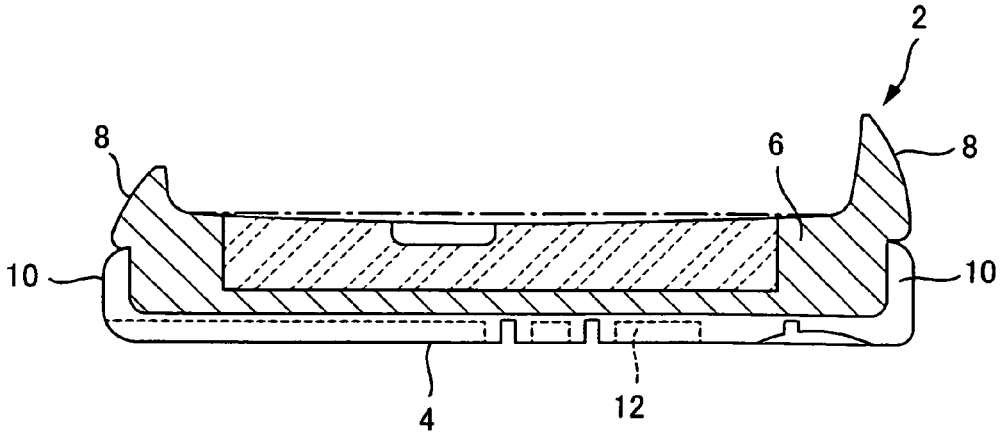
FIG. 12 is a sectional view taken along line XII-XII shown in each of the drawings in FIG. 9.

FIGS. 6-8 show a second embodiment of an athletic shoe according to the present invention, where FIG. 6 is a side view of an athletic shoe, FIG. 7 is a side view showing the outer side-portion of the sole of the athletic shoe shown in FIG. 6, FIG. 8(*a*) is a sectional view taken along line IIXa-IIXa shown in FIG. 7, similarly, FIG. 8(*b*) is a sectional view taken along line IIXb-IIXb shown in FIG. 7, and FIG. 8(*c*) is also a sectional view taken along line IIXc-IIXc shown in FIG. 7.

Regarding the athletic shoe of the second embodiment, a reinforcing member is further provided to the previously described tennis shoe of the first embodiment, which restrains the outward swelling deformation of the upper member, from the bulged portion 29 formed at the portion along which a little toe at the circumferential side face of the midsole 22 is located to the upper member at a portion thereabove. That is, the position where the reinforcing member is placed is the point that differs from the tennis shoe of the first embodiment, and the remaining parts shown in FIGS. 1-5 are basically in common with those of the second embodiment having identical configuration. Therefore, the structural section where the reinforcing member is arranged, which differs, is explained in detail below, and a brief explanation on the components that are identical to those of the tennis shoe in the first embodiment are given with identical references attached.

As shown in FIG. 6, the midsole 22 of the sole 20 of the tennis shoe has on its inner side of the raised portion 24 formed along the entire circumference of its circumferential side edge, a lower end circumferential side edge of the upper member 40 bonded and integrally connected thereto. As is also shown in FIG. 7, as similar to the first embodiment (refer to FIGS. 1, 3, and 5), this midsole 22 has at a portion along the little toe located ahead of the shank portion 28 at the outer foot side of its circumferential side face 22*a*, a bulged portion 29 integrally formed to protrude outward. This bulged portion 29 has a thickness equal to or more than that substantially corresponding to the thickness of the raised portion 24 of the midsole 22 in the shoe width direction. And to this bulged portion 29, an extending portion 32 is formed to extend from the perimeter edge of the outer sole toward its protruding surface. Further, the extending portion 32 has along nearly its entire length, a large arcuate curve with a radius of approximately 10 mm made to round the protruding surface of the bulged portion 29.

By the way, as shown in FIGS. 6-8(*a*), this second embodiment has at the bulged portion 29 of the above-described midsole 22, a reinforcing member 42 embedded to restrain the upper member 40 from swelling outward. As shown in FIG. 8(*a*), this reinforcing member 42 is in a planar form extending in the shoe width direction across and through the bulged portion 29. And as shown in FIG. 6, its upper end 42*a* extends upward beyond the bulged portion 29 to reach the outer side face of the upper member 40 and then is bonded to the upper member 40. Also, as shown in FIG. 8(*a*), the reinforcing member 42 contacts and then is joined to the bottom end portion of the upper member 40 connected to the inner side face of the raised portion 24 to which the bulged portion 29 is formed.

On the other hand, as shown in FIGS. 6 and 7, the outer side circumferential edge portion of the reinforcing member 42 is made to go round the bulged portion 29 and penetrate through the extending portion 32 of the outer sole 30, which covers the bulged portion 29, to be exposed. Furthermore, the reinforcing member 42 has its upper side provided in a state inclined forward in the length direction of the shoe. And in the illustrated second embodiment, the reinforcing member 42 is provided to the bulged portion 29 at two locations, at the front and back, in the length direction of the shoe. Here, as a material of the reinforcing member 42, resin that is more rigid than the midsole 22 (for instance, thermoplastic polyurethane (TPU) and such) is preferably adopted. Further, the number of reinforcing members 42 to be located need not be two, but a number as required.

In addition, as shown in FIG. 8(*a*), the reinforcing member 42 has, along the upper surface of the above described midsole 22, integrally formed an extending piece 42*c* extending toward the middle of the shoe in the width direction. This extending piece 42*c* is embedded in flush with the upper surface of the midsole 22, and is formed in a form identical to the smooth curvature, which extends from the upper surface of this midsole 22 up to the inner side surface of the bulged portion 29, to conform thereto. Also, the bottom end portion 42*b* of the reinforcing member 42 extends up to a position below the upper surface of the midsole 22 close to the upper surface of the outer sole 30, and this bottom end portion 42*b* and the above described extending piece 42*c* are connected to have an arcuate curved appearance.

Furthermore, at the circumferential edge of the reinforcing member 42 on the inner side of the shoe, in other words, at the circumferential edge portion of the reinforcing member 42 along the inner side surface to the upper surface of the bulged portion 29 of the midsole 22, a flange portion 44 is integrally formed to extend toward the front and back in the length direction of the shoe. This flange portion 44 is also embedded in flush with the midsole 22 without a level difference.

With the tennis shoe of the second embodiment having a reinforcing member 42 configured as explained above, in addition to the operational advantages achieved by the tennis shoe of the above-described first embodiment, the following exceptional operational advantages can be further achieved.

To be specific, while playing tennis, when the foot portion is made to slide transverse to the direction of movement while making effort to hold on, or when the foot portion makes effort to hold on to sprint in the side direction, a side force (in the shoe width direction) toward the outside is applied from the foot portion to the upper member 40. Although this force concentrates around the bulged portion 29, which is a particular feature of the present invention, if the above-mentioned reinforcing member 42 is provided to the bulged portion 29, the above-mentioned side force can be received by the reinforcing member 42. Consequently, the rigidity increases at the area around the portion where the reinforcing member 42 is located, to restrain the swelling deformation of the upper member 40 in the outward direction as much as possible, so that the ability to retain the foot portion can be improved to a great extent, and twisting of the ankle or the like can be consistently avoided all the more.

Further, with the reinforcing member 42 shaped in a plate form extending in the shoe width direction and penetrating through the bulged portion 29 of the midsole 22, and further configured to be joined to the upper member 40 connected to the inner side surface of the bulged portion 29, the rigidity of the reinforcing member 42 itself is increased to the maximum extent and the deformation of the upper member 40 can be further restrained.

Additionally, an extending piece 42*c* that extends toward the middle of the shoe in the width direction along the upper surface of the midsole 22 is integrally formed with the reinforcing member 42, and this extending piece 42*c* is configured to be embedded in flush with the relevant upper surface. In this way, the inclination force, which occurs when sliding sideways or the like, toward the outside at the upper side of the reinforcing member 42 can be canceled by a vertical load applied to the extending piece 42*c* by the foot portion. Herewith, the inclination force is relieved and the swelling deformation of the upper member 40 is further restrained so that the ability to retain the foot portion can be further improved.

Furthermore, by integrally forming the flange portion 44 that extends toward the front and back of the shoe in the length direction at the circumferential edge of the reinforcing member 42 on the inner side of the shoe, the area of the reinforcing member 42 that is subject to pressure can be enlarged relative to the foot portion so that the ability to retain the foot portion, in the portion where the reinforcing member 42 is located, can be improved.

In addition, when sprinting or the like in the forward direction, at the time bending occurs to the sole member comprising the outer sole 30 and the midsole 22, oblique wrinkles are developed at the upper member 40 sloping downward from the instep side of the foot along both side portions thereof toward the heel side. However, owing to this configuration where the reinforcing member 42 is provided obliquely with its upper side directed forward in the shoe length direction in accordance with the development of these wrinkles, when the heel portion is lifted, a flexible deformation can be realized without interfering with the bending of the shoe.

Note that, each of the above-described embodiments is for a better understanding of the present invention and is not for limiting interpretation of the invention. Various changes and modification can be made without departing from the spirit and scope of the invention, and its equivalents are included within the scope of the present invention.

INDUSTRIAL APPLICABILITY

The present invention can be used in a wide range, and can be applied to any athletic goods of other sports events beside tennis shoes explained in the above-described embodiments.

The invention claimed is:

1. An athletic shoe, comprising:

an upper member;

a midsole that includes a raised portion connected to the upper member, the raised portion being formed along its circumferential side edge;

a bulged portion that is formed integrally with the midsole at a portion along a little toe of the circumferential side surface of the midsole and that protrudes outward;

an outersole that includes an outsole and that is affixed to an undersurface of the midsole; and an extending portion that is formed at a perimeter edge of the outersole, wherein at the portion along the little toe of the circumferential side surface of the midsole the extending portion extends toward a protruding surface of the bulged portion and has an arcuate curved form, at a portion of the extended portion along a thenar on an inner foot-side of the midsole extends toward the circumferential side surface of the midsole and has an arcuate curved form, and a radius of the arcuate curved form of the extending portion is larger at the portion along the thenar than at the portion along the little toe.

* * * * *